US005078108A

United States Patent [19]

Ishikawa et al.

[11] Patent Number: 5,078,108

[45] Date of Patent: Jan. 7, 1992

[54] THROTTLE CONTROL SYSTEM FOR INTERNAL COMBUSTION ENGINE

[75] Inventors: Yoshikazu Ishikawa, Tokyo; Masaaki Saito, Kanagawa, both of Japan

[73] Assignee: Nissan Motor Company, Ltd., Yokohama, Japan

[21] Appl. No.: 513,710

[22] Filed: Apr. 24, 1990

[30] Foreign Application Priority Data

Apr. 27, 1989 [JP] Japan ..... 1-108156

[51] Int. Cl.[5] ..... F02D 9/10

[52] U.S. Cl. ..... 123/342; 123/403

[58] Field of Search ..... 123/342, 403, 400

[56] References Cited

U.S. PATENT DOCUMENTS

| | | | |
|---|---|---|---|
| 2,148,729 | 2/1939 | Coffey | 123/342 |
| 4,362,138 | 12/1982 | Krueger et al. | 123/342 |
| 4,424,781 | 1/1984 | Speer et al. | 123/403 |
| 4,548,176 | 10/1985 | Ishida et al. | 123/342 |
| 4,721,281 | 1/1988 | Kratt et al. | 123/400 |

FOREIGN PATENT DOCUMENTS

| | | | |
|---|---|---|---|
| 2809894 | 9/1979 | Fed. Rep. of Germany | 123/342 |
| 214199 | 1/1925 | United Kingdom . | |

*Primary Examiner*—Andrew M. Dolinar

*Attorney, Agent, or Firm*—Pennie & Edmonds

[57] ABSTRACT

A throttle control system for an internal combustion engine includes a first lever which is pivotable around a longitudinal axis of a throttle shaft depending upon movement of an accelerator pedal, and a second lever which extends radially from the throttle shaft and is fixed thereto. The system further includes a transmitting mechanism which mechanically transmits pivotal motion of the first lever to the second lever so that the angular position of a throttle valve fixed to the throttle shaft varies in response to depression of the accelerator pedal. The transmitting mechanism optionally changes the ratio of the pivotal angle of the first lever from that of the second lever, so as to change the relationship between the depression rate of the accelerator pedal and the opening angle of the throttle valve.

6 Claims, 4 Drawing Sheets

THROTTLE CONTROL SYSTEM FOR INTERNAL COMBUSTION ENGINE

BACKGROUND OF THE INVENTION

1. Field of the Invention

The present invention relates generally to a throttle control system for an internal combustion engine for automotive vehicle, which can mechanically change the angular position of a throttle valve in response to depression of an accelerator pedal.

2. Description of the Prior Art

Usually the throttle valve of, for example, a gasoline engine for an automotive vehicle is directly connected to an accelerator pedal via an accelerator wire, so that an opening angle of the throttle valve uniformly varies in response to the depression rate of the accelerator pedal. Therefore, when the vehicle travels in a traffic snarl, it is required that the driver finely operate the accelerator pedal. In addition, automatic power control in the case of wheel slippage, i.e. so-called traction control system can not be performed.

In order to eliminate the aforementioned disadvantages, in recent years, various throttle control systems have been proposed in which control of the throttle valve of an internal combustion engine is performed by means of an electric motor. In a system of this type, the depression rate of the accelerator pedal is detected as an electrical signal by means of a potentiometer and so forth. In response to the detected signal, a control circuit produces an output signal which causes the electrical motor comprising a pulse motor or a DC motor to drive, so that the throttle valve connected to the motor pivots depending upon the rotation of the motor. That is, the accelerator pedal operated by the driver is connected to the throttle valve only in an electrical manner, and the electric motor directly drives the throttle valve. This construction is described, for example, in Japanese Patent First (unexamined) Publication (Tokkai Sho.) No. 62-214241. In this way, the relationship between the depression rate of the accelerator pedal and the opening angle of the throttle valve can be changed, power control in the case of wheel slippage and so forth can be easily performed.

However, according to conventional systems in which the electrical motor directly changes the opening angle of the throttle valve for the internal combustion engine, the opening angle of the throttle valve may greatly differ from the depression rate of accelerator pedal operated by the driver. Particularly, it is undesirable for the actual opening angle of the throttle valve to remain large though the driver' foot has been released from the accelerator pedal in order to fully close the throttle.

SUMMARY OF THE INVENTION

It is therefore a principal object of the present invention to eliminate the aforementioned disadvantages and to provide a throttle control system which can change the relationship between the depression rate of the accelerator pedal and the opening angle of the throttle valve by mechanically connecting the accelerator pedal to the throttle valve.

In order to accomplish the aforementioned and other objects, a throttle control system for an internal combustion engine is disclosed, which includes a mechanical transmitting mechanism which can mechanically change the opening angle of a throttle valve in response to depression of an accelerator pedal and which can mechanically change the relationship between the opening angle of the throttle valve and the depression rate of the accelerator pedal.

According to one aspect of the present invention, a throttle control system for an internal combustion engine comprises:

a throttle shaft having a longitudinal axis and being rotatable around the longitudinal axis, the throttle shaft being connected to a throttle valve of the internal combustion engine such that the opening angle of the throttle valve varies depending upon the rotation of the throttle shaft;

a first member pivotably supported on the throttle shaft and radially extending from the longitudinal axis, the first member being pivotable depending upon the depression rate of an accelerator pedal;

a second member secured to the throttle shaft and radially extending from the longitudinal axis;

transmitting means for mechanically engaging the first and second members to transmit pivotal motion of the first member to the second member; and means, associated with the transmitting means, for changing the ratio of pivotal angle of the first member with respect to the second member so as to change the relationship between the depression rate of the accelerator pedal and the opening angle of the throttle valve.

The transmitting means may be a third member which is pivotable around a pivotal axis essentially parallel to the longitudinal axis of the throttle shaft, and the means may cause the pivotal axis of the third member to move in a radial direction of the longitudinal axis of the throttle shaft. The third member may have a pair of arm portions which extend radially from the pivotal axis thereof and in opposite directions to each other, one of the arm portions engaging the first member so as to move depending upon the pivotal motion of the first member, and the other arm portion engaging the second member so as to transmit the pivotal motion of the first member to the second member. Each of the arm portions may have an elongated opening which extends radially from the pivotal axis, and each of the first and second members may have a pin at a location neighboring the free end thereof, the pins engaging the corresponding elongated openings of the arm portions so as to permit the movement of the pins along the elongated openings depending upon the pivotal motion of the third member.

According another aspect of the invention, a throttle control system for an internal combustion engine comprises:

a throttle shaft having a longitudinal axis and being rotatable around the longitudinal axis, the throttle shaft being connected to a throttle of the internal combustion engine such that the angular position of the throttle varies depending upon the rotation of the throttle shaft;

a first member pivotably supported on the throttle shaft, the first member being pivotable around a first pivotal axis essentially similar to the longitudinal axis of the throttle shaft depending upon the depression rate of an accelerator pedal;

a second member fixed to the throttle shaft and being pivotable together with the throttle shaft;

a third member engaging the first and second members, the third member being pivotable around a second pivotal axis essentially parallel to the longitudinal axis of the throttle shaft so as to transmit the pivotal motion of the first member to the second member;

a supporting member which pivotably supports the third member; and driving means, associated with the supporting member, for causing the second pivotal axis of the third member to move in a radial direction of the throttle shaft, so as to change the relationship between the angular positions of the first and second members.

The first and second members may respectively extend in a radial direction of the throttle shaft, and the third member may have a pair of arm portions which extend radially from the second pivotal axis and in opposite directions to each other, one of the arm portions engaging the first member so as to move depending upon the pivotal motion of the first member, and the other arm portion engaging the second member so as to transmit the pivotal motion of the first member to the second member. Each of the arm portions may have an elongated opening which extends radially from the second pivotal axis, and each of the first and second members may have a pin at a location neighboring the free end thereof, the pins engaging the corresponding elongated openings of the arm portions so as to permit the movement of the pins along the elongated openings depending upon the pivotal motion of the third member.

BRIEF DESCRIPTION OF THE DRAWINGS

The present invention will be understood more fully from the detailed description given hereinbelow and from the accompanying drawings of the preferred embodiment of the invention. The drawings are not intended to imply limitation of the invention to a specific embodiment, but are for explanation and understanding purposes only.

In the drawings.

DESCRIPTION OF THE PREFERRED EMBODIMENT

Figure 1:
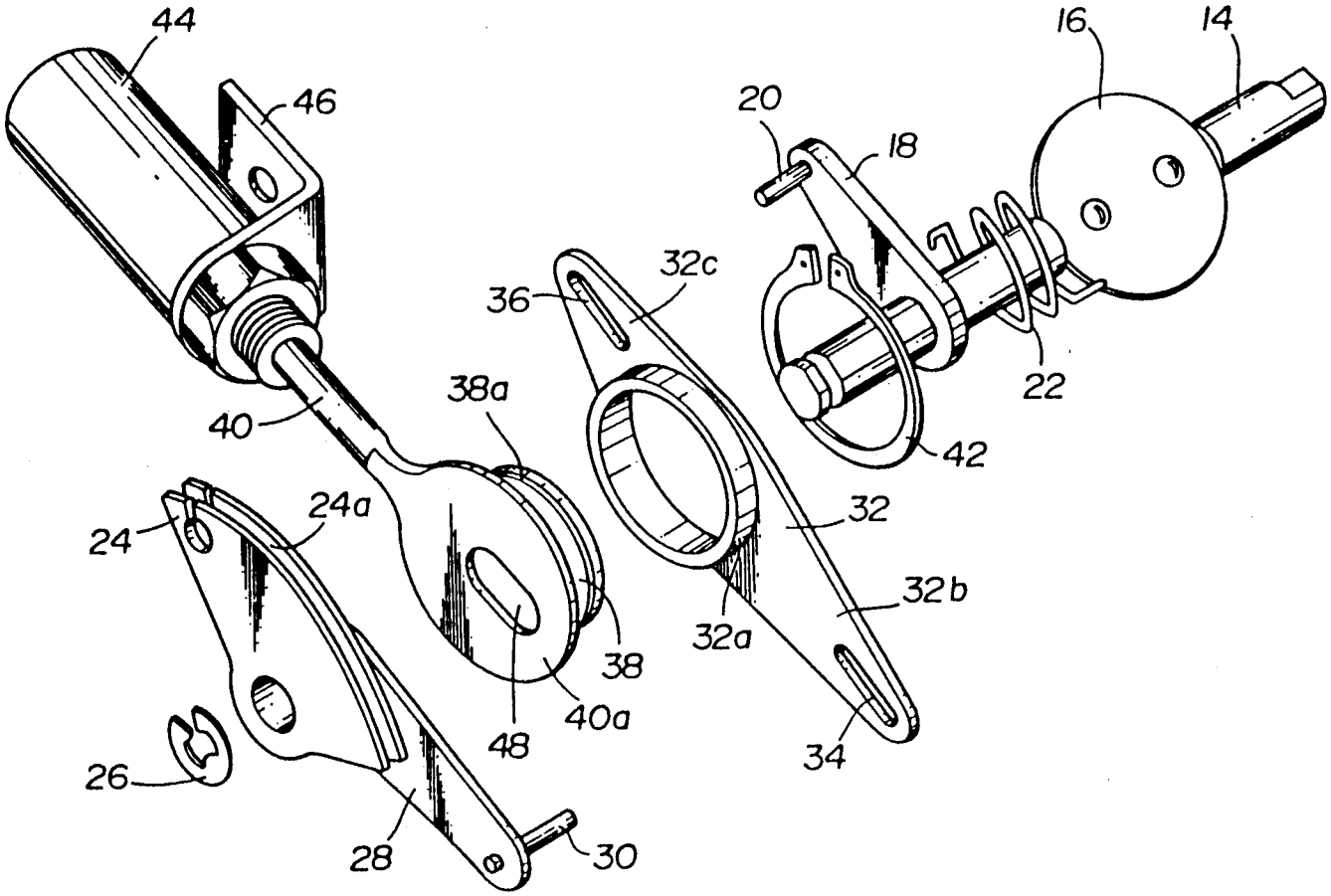
FIG. 1 is an exploded, perspective view of the preferred embodiment of a throttle control system, according to the present invention.
Figure 2:
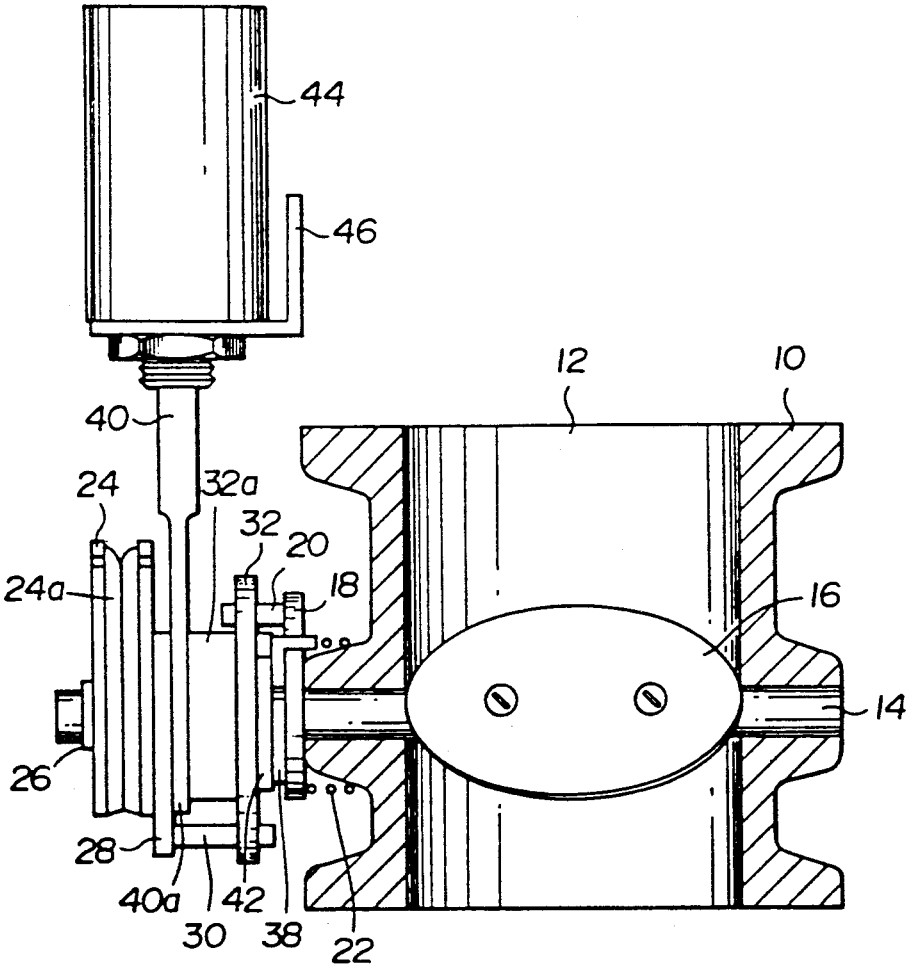
FIG. 2 is a sectional view of the throttle control system of FIG. 1 which shows the assembled system.

Referring now to the drawings, particularly to FIGS. 1 and 2, a throttle chamber 10 defining an essentially cylindrical intake passage 12 therein is connected to an inlet port of an intake collector (not shown). The intake passage 12 of the throttle chamber 10 is traversed by a throttle shaft 14 which passes through the throttle chamber 10 to be rotatably supported thereon. A disc-shaped throttle valve 16 is arranged in the intake passage 12 and is secured to the throttle shaft 14 so as to be pivotable depending upon the rotation of the throttle shaft 14. The outer diameter of the throttle valve 16 is substantially equal to or slightly smaller than the inner diameter of the throttle passage 12 so as to allow the throttle valve 16 to blocks fluid communication between the upstream and downstream of the throttle valve 16 within the intake passage 12.

One end portion of the throttle shaft 14 projects from the side wall of the throttle chamber 10. The projecting portion of the throttle shaft 14 supports a second lever 18 which extends in an essentially perpendicular to the throttle shaft 14 and is secured thereto at a location neighboring the side wall of the throttle chamber 10. The second lever 18 has a pin 20 which is arranged at the free end thereof so as to extend essentially parallel to the throttle shaft 14. The throttle shaft 14 is biased by means of a return spring 22 which is comprised of a coil spring so that the throttle valve 16 securely blocks fluid communication within the intake passage 12 when no rotation force is applied to the throttle shaft 14.

The projecting portion of the throttle shaft 14 pivotably supports a sector-shaped throttle drum 24 thereon at a location neighboring the end thereof. In order to prevent the throttle drum 24 from disengaging from the throttle shaft 14, an E-shaped ring 26 is arranged at a location neighboring the end of the projecting portion of the throttle shaft 14. The throttle drum 24 is connected to one end of an accelerator wire (not shown), the other end of which is connected to an accelerator pedal (not shown). The accelerator wire is designed to be wound within a groove 24*a* formed in the periphery of the throttle drum 24, so that the throttle drum 24 pivots depending upon the depression rate of the accelerator pedal.

A first lever 28 is secured to the side wall of the throttle drum 24, and extends essentially perpendicular to the throttle shaft 14. The first lever 28 has a pin 30 which is arranged at a location neighboring the free end thereof so as to extend essentially parallel to the throttle shaft 14. In the shown embodiment, the pivotal axis of the first lever 28 coincides with the longitudinal axis of the throttle shaft 14.

An intermediate lever 32 is arranged between the first and second levers 28 and 18. The intermediate lever 32 comprises a bearing portion 32*a* having an essentially cylindrical through opening, and a pair of plate portions 32*b* and 32*c* which extend from the bearing portion 32*a* in opposite directions to each other. The plate portions 32*b* and 32*c* respectively have elongated through openings 34 and 36 which respectively engage the pin 30 of the first lever 28 and the pin 20 of the second lever 18.

An essentially cylindrical guide ring 38 serving as a guiding member is arranged between the throttle drum 24 and the intermediate lever 32. The guide ring 38 is integrally formed with a flange portion 40*a* of a control rod 40. The guide ring 38 is received in the bearing portion 32*a* of the intermediate lever 32, so that the intermediate lever 32 is pivotably supported on the guide ring 38. The guide ring 14 has an annular groove 38*a* on the periphery thereof, which engages a snap ring 42 so as to hold the intermediate lever 32 at a predetermined position. An actuator 44 serving as a driving source is designed to cause the control rod 40 to move linearly in a direction essentially perpendicular to the longitudinal axis of the throttle shaft 14, or in an essentially longitudinal direction of the intermediate lever 32 when the throttle valve 16 is positioned at its fully closed position in which the throttle valve 16 securely blocks the fluid communication in the intake passage 12 of the throttle chamber 10. The actuator 44 has therein an electric motor, such as a pulse motor, and is designed to change its rotational motion into a rectilinear motion. The actuator 44 is fixed to a given mounting portion by means of a bracket 46. Furthermore, the flange portion 40a of the control rod 40 has an elongated through opening 48 which extends in a longitudinal direction of the control rod 40.

With this construction, the operation of the throttle control system is described below.

As mentioned above, the first and second levers 28 and 18 may pivot around the longitudinal axis of the throttle shaft 14. The common pivotal axis of these levers 28 and 18 are shown by a point O in FIGS. 3 and 4. In addition, the intermediate lever 32 may pivot around the center of the guide ring 38 which is shown by a point $O_1$ in FIGS. 3 and 4. Although the point O is a fixed point, the point $O_1$ expressing the pivotal axis of the intermediate lever 32 is movable in a radial direction of the throttle shaft 14.

When the accelerator pedal (not shown) is depressed, the first lever 28 pivots by an angle corresponding to the depression rate of the accelerator pedal, so that the intermediate lever 32 pivots in the same pivotal direction as that of the first lever 28 via the pin 30. The pivotal motion of the intermediate lever 32 is transmitted to the second lever 18 via the pin 20, so as to cause the throttle valve 16 together with the throttle shaft 14 to pivot.

Figure 3:
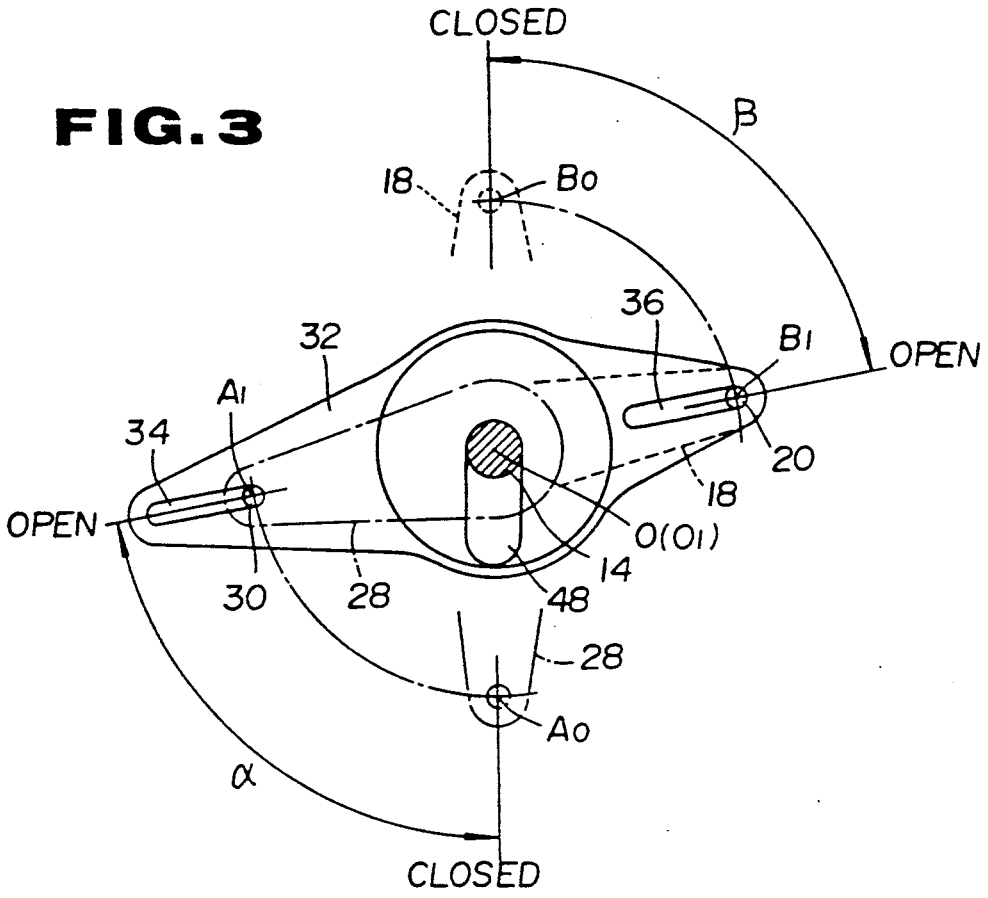
FIG. 3 is a schematic view of the major portion of the throttle control system of FIG. 1, which describes the movements of the levers when the offset distance is zero.

When the central point $O_1$ of the guide ring 38 coincides with the longitudinal axis of the throttle shaft 14 as shown in FIG. 3, all of the first, second and intermediate levers 28, 18 and 32 may pivot together at the same angle as each other. In FIG. 3, the first lever 28 pivots from a minimum angular position $A_0$, in which the depression rate of the accelerator pedal is zero, to a maximum angular position $A_1$, in which the depression rate of the accelerator pedal is the maximum. Depending upon this pivotal motion of the first lever 28, the second lever 18 pivots from the minimum angular position $B_0$ to the maximum angular position $B_1$. In this case, the pivotal angle $\alpha$ of the first lever 28 is equal to the pivotal angle $\beta$ of the second lever 18. This construction is same as that when the throttle drum 24 is directly mounted on the throttle shaft 14.

Figure 4:
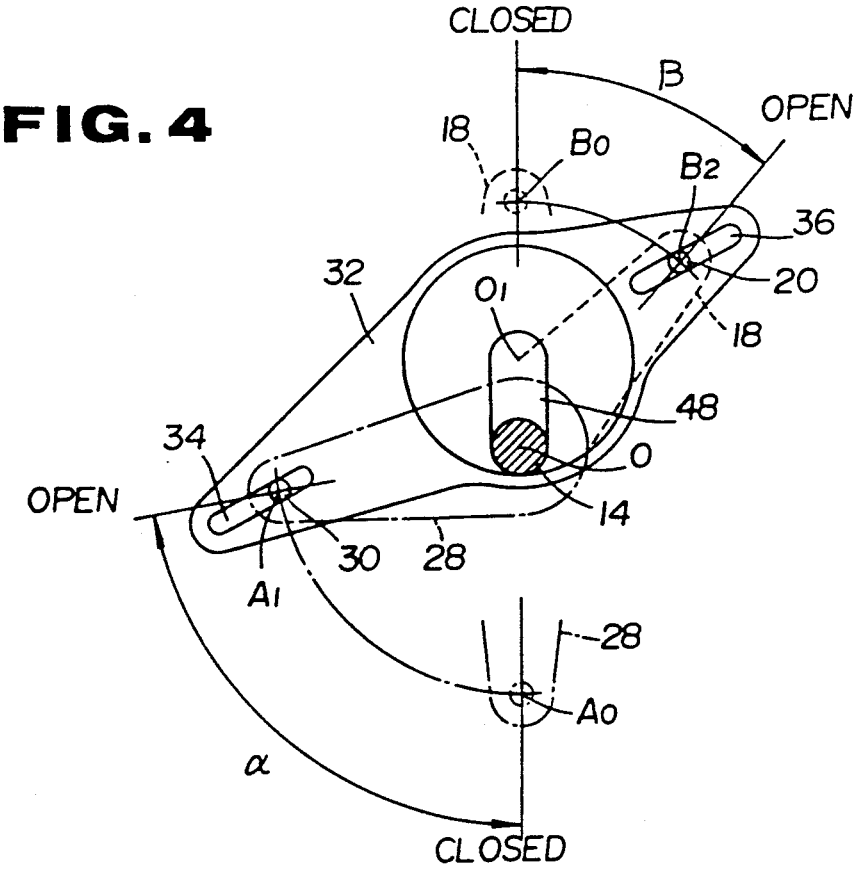
FIG. 4 is a schematic view of the major portion of the throttle control system of FIG. 1, which describes the movement of the levers when a proper offset distance exists.

On the other hand, when the center point $O_1$ of the guide ring 38 offsets from the longitudinal axis of the throttle shaft 14 as shown in FIG. 4, the pivotal angle $\alpha$ of the first lever 28 differs from the pivotal angle $\beta$ of the second lever 18. In FIG. 4, the central point $0_1$ of the guide ring 38 offsets toward the pin 20 arranged when the throttle valve 16 is positioned at its fully closed position. In this case, although the first lever 28 pivots by the angle $\alpha$ from the minimum angular position $A_0$ to the maximum angular position $A_1$, the second lever 18 may pivot only by a smaller angle $\beta$ than the angle $\alpha$ from the minimum angular position $B_0$ to the maximum angular position $B_2$. Therefore, the actual change of the opening angle of the throttle valve 16 becomes small relative to the depression rate of the accelerator pedal, which is appropriate for vehicular driving in a traffic snarl.

Figure 5:
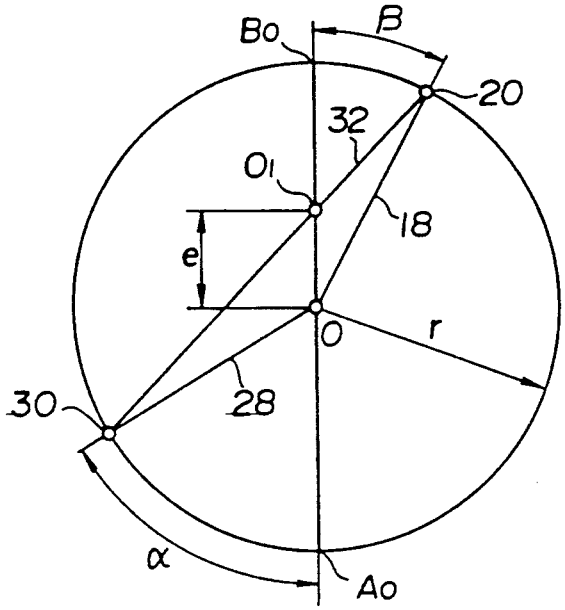
FIG. 5 is an explanatory drawing which describes working principle of the throttle control system of FIG. 1.

FIG. 5 shows schematically the aforementioned construction. In FIG. 5, in order to facilitate understanding, it is assumed that the radii of the first and second levers 28 and 18, i.e. the distances between the pivotal axis O and the pins 30 and 20 are equal to each other, and the central point $O_1$ of the guide ring 38 moves along a line drawn between the minimum angular position $A_0$ of the first lever 28 and the point O. As can be seen from this drawing, the pivotal angle $\beta$ of the second lever 18, which is equal to that the opening angle of the throttle valve 16, is subject to the following formula:

$$\beta = 2\tan^{-1}\left\{\left(\frac{r-e}{r+e}\right)\tan(\alpha/2)\right\}$$

wherein r is the radius of the first and second levers 28 and 18, and e being the offset distance of the central point $O_1$ of the guide ring 38 from the point O. If the radius of the first lever 28 differs from that the second lever 18 to some degree, or if the moving direction of the central point $O^1$ is offset from the line drawn between the points $A_0$ and O to some degree, the aforementioned formula may still be approximately applied. In addition, the point $O_1$ may move toward either point $A_0$ or $B_0$, so that the offset distance e may take either a positive or negative value.

Therefore, if the actuator 44 causes the offset distance e to change appropriately, the relationship between the depression rate of the accelerator pedal and the actual opening angle of the throttle valve 16 may be optionally changed. As a result, for example, the rate of change of the opening angle of the throttle valve 16 relative to the depression rate of the accelerator pedal may be reduced in a case where the vehicle runs at a low-speed or reversely. In this way it is possible to assure smooth driving and to easily achieve a traction control and so forth when a wheel slippage is detected.

As can be seen clearly from FIGS. 3 and 4, the minimum angular position $B_0$ of the second lever 18, which corresponds to the minimum angular position $A_0$ of the first lever 28, is constant in no relation to the offset distance e. That is, the movement of the guide ring 38 by the actuator 44 does not affect the minimum angular position $B_0$ of the second lever 18. Therefore, when the first lever 28 returns to the minimum angular position $A_0$ by the release of the accelerator pedal by the driver's foot, the throttle valve 16 is positioned at its fully closed position regardless of the position of the guide ring 38. Accordingly, even if the actuator or control circuits (not shown) are broken, it is possible to surely prevent engine speed from excessively increasing. When the moving direction of the point $O^1$ is slightly offset from the line drawn between points $A_0$ and O, the opening angle of the throttle valve 16 changes to some degree. However, the change in engine speed is very small due to this change of the opening angle of the throttle valve 16, and causes no problems.

In addition, according to the aforementioned construction, there is an advantage in that the change of the depression force against the accelerator pedal is not so large if the relationship between pivotal angle $\alpha$ of the first lever 28 and the pivotal angle $\beta$ of the second levers 18 changes due to the change of the offset distance e. Strictly speaking, the reaction force applied to the first lever 28 by the return spring 22 changes depending on change of the offset distance e. However, since the spring force of the return spring 22 is very small relative to the depression force to the accelerator pedal, the change of the depression force can be ignored. Therefore, the driver can always depress the accelerator pedal with a similar operational 'feel'.

According to the present invention, idling engine speed adjustment can be performed by slightly offsetting the moving direction of the point $O_1$ from the line drawn between the central point O and the point $A_0$ which is the minimum angular position of the first lever 28, by means of the actuator 44.

Figure 6:
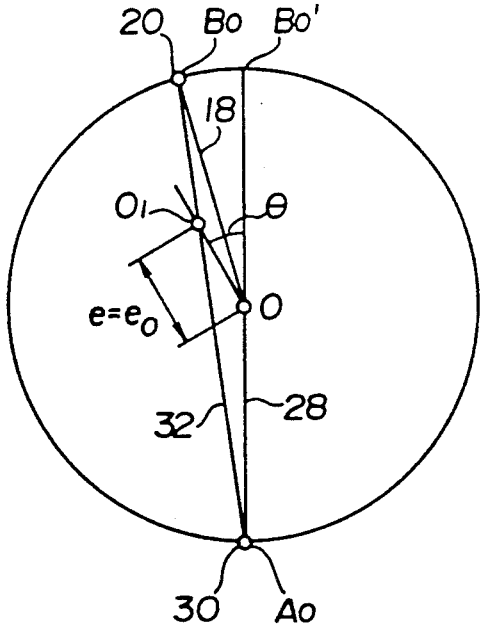
FIG. 6 is an explanatory drawing which describes working principle of the throttle control system of FIG. 1 in a case where the system is applied to idling engine speed adjustment.

FIG. 6 shows an example in which the moving direction of the point $O_1$ is inclined from the line drawn between points $A_0$ and O by an angle $\theta$. In FIG. 6, in a case where the offset distance e is positioned at a position $e_0$, the minimum angular position $B_0$ of the second lever 18 is set as a reference of the fully closed position of the throttle valve 16. In this case, if the offset distance e is caused to gradually decrease from the aforementioned reference value $e_0$ while the position of the first lever 28 is fixed to the point $A_0$, then the second lever 18 pivots gradually clockwise in FIG. 6 so that the opening angle thereof increases. When the offset distance e becomes zero for example, the minimum angular position $B_0$ of the second lever 18 reaches the point $B_0'$. That is, when the depression rate of the accelerator pedal is zero, or in the case of idling engine speed, the opening angle of the throttle valve 16 can be finely adjusted by the rectilinear motion of the actuator 44. In this way, idling engine speed adjustment can be performed, for example, by a closed loop control. In particular, according to the aforementioned construction, there is an advantage in that high accuracy control of the actuator 16 is not required as compared with the conventional systems in which the throttle valve 16 is directly driven by a pulse motor or the like. In addition, the idling engine speed adjustment can be performed while the aforementioned control of the opening angle of the throttle valve is performed.

Though the present invention has been described as a throttle control system, applied to a gasoline engine in which a throttle valve is directly connected to a throttle shaft, it should be appreciated that the throttle control system of the invention can be applied to other engines, such as a diesel engine, without departing from the principle of the invention.

As mentioned above, a throttle control system, according to the present invention, can change the relationship between the accelerator pedal position input and the opening angle of the throttle valve by moving the pivotal axis of the intermediate lever while the accelerator pedal is basically connected to the throttle valve in a mechanical manner. Therefore, if any control system is broken, it is possible to prevent having the actual opening angle of the throttle valve from significantly departing from the depression rate of the accelerator pedal. That is, when the depression rate of the accelerator pedal is zero, the opening angle of the throttle valve can be surely positioned to its fully closed position even if the control system is broken.

In addition, if the relationship between the depression rate of the accelerator pedal and the opening angle of the throttle valve is changed, the depression force to the accelerator pedal is substantially constant so that the driver can stably depress the accelerator pedal.

What is claimed is:

1. A throttle control system for an internal combustion engine, comprising:

a throttle shaft having a longitudinal axis and being rotatable around said longitudinal axis, said throttle shaft being connected to a throttle valve of the internal combustion engine such that the opening angle of the throttle valve varies depending upon the rotation of the throttle shaft;

a first member being pivotable about said throttle shaft and radially extending from said longitudinal axis, said first member being pivotable depending upon the depression rate of an accelerator pedal;

a second member secured to said throttle shaft and radially extending from said longitudinal axis;

a third member for mechanically engaging the first and second members to transmit the pivotal motion of the first member to the second member, said third member having a through opening for receiving said throttle shaft therein, and being pivotable about said throttle shaft; and means, associated with said third member, for shifting the pivotal axis of said third member about a radial direction relative to said longitudinal axis of the throttle shaft, to change the ratio of the pivotal angle of the first member to that of the second member so as to change the relationship between the depression rate of the accelerator pedal and the opening angle of the throttle valve.

2. A throttle control system for an internal combustion engine, comprising:

a throttle shaft having a longitudinal axis and being rotatable around said longitudinal axis, said throttle shaft being connected to a throttle valve of said internal combustion engine such the opening angle of said throttle valve varies depending upon the rotation of said throttle shaft;

a first member being relatively pivotable about said throttle shaft and extending from said longitudinal axis, said first member being pivotable depending upon the depression rate of an a accelerator pedal;

a second member secured to the throttle shaft and radially extending from said longitudinal axis;

a third member for mechanically engaging the first and second members to transmit the pivotal motion of the first member to the second member, said third member being pivotable around a pivotal axis essentially parallel to said longitudinal axis of the throttle shaft, said third member having a pair of arm portions which extend radially from said pivotal axis thereof and in opposite directions to each other, one of the arm portions engaging the first member so as to move depending upon the pivotal motion of the first member and the other arm portion engaging the second member so as to transmit the pivotal motion of the first member to the second member; and means, associated with said third member, for causing the pivotal axis of the third member to move in a radial direction of said longitudinal axis of the throttle shaft, to change the ratio of the pivotal angle of the first member to that of the second member so as to change the relationship between the depression rate of the accelerator pedal and the opening angle of the throttle valve.

3. A throttle control system as set forth in claim 2, wherein each of said arm portions has an elongated opening which extends radially from the pivotal axis, and each of said first and second members has a pin at a location neighboring the free end thereof, said pins engaging the corresponding elongated openings of said arm portions so as to permit movement of said pins along said elongated openings depending upon the pivotal motion of said third member.

4. A throttle control system for an internal combustion engine, comprising:

a throttle shaft having a longitudinal axis and being rotatable around said longitudinal axis, said throttle shaft being connected to a throttle of said internal combustion engine such that the angular position of the throttle varies depending upon the rotation of said throttle shaft;

a first member being relatively pivotable about said throttle shaft, depending upon the depression rate of an accelerator pedal;

a second member fixed to said throttle shaft and being pivotable together with said throttle shaft;

a third member engaging said first and second members, said third member having a through opening for receiving therein said throttle shaft, and being relatively pivotable about said throttle shaft so as to transmit the pivotal motion of said first member to said second member;

a supporting member which pivotably supports said third member; and driving means, associated with said supporting member, for causing the second pivotal axis of said third member to move in a radial direction of said throttle shaft, so as to change the relationship between the angular positions of said first and second members.

5. A throttle control system for an internal combustion engine, comprising:

a throttle shaft having a longitudinal axis, and being rotatable around said longitudinal axis, said throttle shaft being connected to a throttle of said internal combustion engine such that the angular position of said throttle varies depending upon the rotation of said throttle shaft;

a first member pivotably supported on said throttle shaft and extending in a radial direction of said throttle shaft, said first member being relatively pivotable around a first pivotal axis essentially similar to said longitudinal axis of the throttle shaft depending upon the depression rate of an acceleration pedal;

a second member fixed to said throttle shaft and being pivotable together with said throttle shaft;

a third member engaging said first and second members, said third member being pivotable around a second pivotal axis essentially parallel to said longitudinal axis of said throttle shaft so as to transmit pivotal motion of the first member to the second member, said third member having a pair of arm portions which extend radially from said second pivotal axis and in opposite directions to each other, one of the arm portions engaging said first member so as to move depending upon the pivotal motion of said first member, and the other arm portion engaging said second member so as to transmit the pivotal motion of said first member to said second member;

a supporting member which pivotably supports said third member; and driving means, associated with said supporting member, for causing said second pivotal axis of the third member to move in a radial direction of said throttle shaft, so as to change the relationship between the angular postions of said first and second members.

6. A throttle control system as set forth in claim 5, wherein each of said arm portions has an elongated opening which extends radially from said second pivotal axis, and each of said first and second members has a pin at a location neighboring the free end thereof, said pins engaging the corresponding elongated openings of said arm portions so as to permit movement of said pins along said elongated openings depending upon the pivotal motion of said third member.

* * * * *